US007108576B2

(12) United States Patent
LaPointe

(10) Patent No.: US 7,108,576 B2
(45) Date of Patent: Sep. 19, 2006

(54) FOAM PROJECTILE EXHIBITING AN ILLUMINATING ELEMENT

(75) Inventor: Brian LaPointe, West Yarmouth, MA (US)

(73) Assignee: Poof Products, Inc., Plymouth, MI (US)

( * ) Notice: Subject to any disclaimer, the term of this patent is extended or adjusted under 35 U.S.C. 154(b) by 253 days.

(21) Appl. No.: 10/778,972

(22) Filed: Feb. 13, 2004

(65) Prior Publication Data

US 2005/0260918 A1 Nov. 24, 2005

(51) Int. Cl.
*A63H 27/127* (2006.01)
*A63B 67/06* (2006.01)

(52) U.S. Cl. ..... 446/47; 446/175; 446/219; 473/570

(58) Field of Classification Search ..... 446/47, 446/219, 175; 473/570, 578, 582
See application file for complete search history.

(56) References Cited

U.S. PATENT DOCUMENTS 5,032,098 A * 7/1991 Balogh et al. ..... 446/47
5,102,131 A * 4/1992 Remington ..... 473/570
5,186,458 A * 2/1993 Redondo ..... 473/570
5,388,825 A * 2/1995 Myers et al. ..... 473/570
5,490,047 A * 2/1996 O'Rourke et al. ..... 473/570
5,564,964 A 10/1996 Chin-Chien ..... 446/406
5,566,949 A * 10/1996 Gorden ..... 273/348.3
5,779,575 A * 7/1998 Hsieh ..... 473/570
5,807,197 A * 9/1998 Grafton ..... 473/594
D422,100 S 3/2000 Zhang ..... D26/2
6,464,602 B1 * 10/2002 Rottger ..... 473/571
6,604,742 B1 * 8/2003 El Sabbagh ..... 273/348.4
2002/0081939 A1 6/2002 Hornsby ..... 446/268

* cited by examiner

*Primary Examiner*—Kien Nguyen
(74) *Attorney, Agent, or Firm*—Gifford, Krass, Groh, Sprinkle, Anderson & Citkowski, P.C.

(57) ABSTRACT

A projectile adapted for being discharged from a suitable firing device such as a gun, slingshot, cannon and the like. The device includes a three-dimensional shaped body constructed of a foam material and which may include such as a disc shaped, conical arrow shape or spherical ball shape. A plurality of LED lighting elements are supported within the foam material body at specified locations and are visible from a surface of the body. A battery is supported within the body and electrically communicates the LED lighting elements. A switch accessibly is located upon the body and selectively engages or disengages the battery with the lighting elements and in order to provide an illuminating effect to the projectile as it is discharged from the device.

11 Claims, 2 Drawing Sheets

FOAM PROJECTILE EXHIBITING AN ILLUMINATING ELEMENT

BACKGROUND OF THE INVENTION

1. Field of the Invention

The present invention relates generally to foam projectile articles. More specifically, the present invention discloses a foam projectile article of a determined shape, capable of being discharged from a gun, slingshot, cannon or the like. The projectile articles exhibit any number of light illuminating elements, such as in particular LED elements, and which provide a maximum degree of durability and impact resilience.

2. Description of the Prior Art

The prior art is well documented with examples of foam projectile discharge articles. One example of this is disclosed in U.S. Pat. No. 5,996,564, issued to Kotowski, and which teaches a disc discharging toy including a body having a hand grip. A plurality of resilient discs are secured within a magazine mounted on the body and in a stacked position. An imparted discharge force is provided by a drive roller to expel each disk in succession from the article. Additional examples of foam discharge articles are also illustrated in reference to U.S. Pat. Nos. 5,471,967 and 5,611,322, both issued to Matsuzuki et al.

U.S. Design Pat. No. 422,100, issued to Zhang, teaches a disc support for an LED light bulb design. U.S. Pat. No. 5,564,964, issued to Chin-Chien, discloses a toy gun with a helically driven reciprocating barrel. Two discs are secured in the gun barrel and a roller is rotatably supported between the discs and has three helical grooves. Three tubes are slidably extended through one of the discs and are engaged with the helical grooves of the roller such that the tubes are moved in reciprocating action when the roller is rotated. Three light bulbs are disposed in the tubes, and the tubes are made of transparent materials having different colors such that the different colors are generated through the tubes when the light bulbs are energized.

U.S. Patent Application Publication 2002/0081939, published to Hornsby et al., teaches a system and method for launching glow-in-the-dark projectiles from a projectile launcher wherein the toy comprises projectiles exposed to light prior to being launched and a firing mechanism wherein a portion of the firing mechanism is positioned with the projectile prior to being fired from the launcher. In one embodiment, the firing mechanism comprises a light for exposing the projectile to radiation prior to being fired from the gun. The present invention is further well suited for use as a toy projectile launcher wherein the toy may be used in dark or low-light areas.

SUMMARY OF THE PRESENT INVENTION

The present invention is a foam projectile exhibiting a given shape and which includes at least one lighted element integrally formed therein. In a preferred embodiment, the lighting element is an LED element and which exhibits the necessary properties of durability and impact resilience.

In a first preferred variant the foam projectile, for use with such as a toy disc discharging gun or rifle, is formed in a substantially disc or coin shape and includes first and second circular shaped and spaced apart faces separated by an annular edge surface. One or more LED lighting elements are supported within the foam projectile body and such that an illuminating light associated with each element is evident from a surface of the body. A suitable battery, such as of the watch variety and exhibiting light weight and portability, is embedded within the foam projectile body and provides power to the LED elements.

In the first disc shaped variant, the LED elements can be located in a central portion of the foam body and which are visible from a selected face. Alternately, the LED elements can be visible at one or more locations about the annular peripheral edge surface.

A further variant of the foam projectile device is provided in a generally conical or modified cylindrical shape and which includes a first LED element located in a more generally pointed nose end of the conical cylindrical foam shape, as well as additional LED elements located about a base periphery. An associated battery is further capable of being supported upon an attaching end of an arrow shaft and the assembly is capable of being fired by a bow (not shown).

In a third variant, the foam projectile device is provided as a two-piece and assembleable foam ball, and such as is capable of being fired from a suitable projectile issuing device. The ball-shaped projectile typically includes a plurality of LED elements arranged at locations about a spherical surface periphery.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
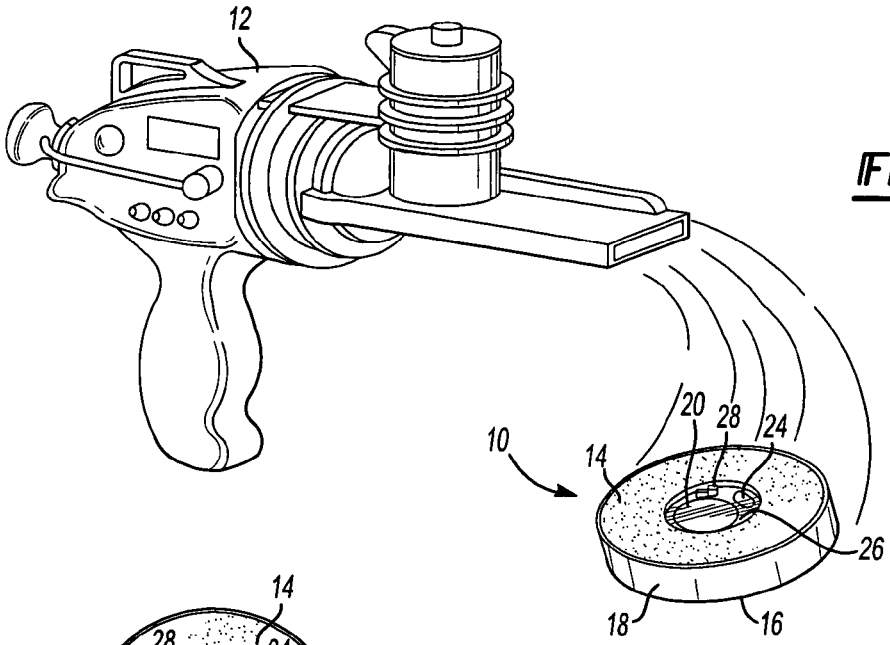
FIG. 1 is an environmental view in perspective of a foam disc projectile with embedded LED lighting elements according to a first preferred variant of the present invention.

Referring now to FIG. 1, a foam disc projectile is illustrated at 10 according to a first preferred variant and which is capable of being discharged from a suitable firing device 12. As previously discussed, the firing device 12 can take any form and may include such as a foam disc discharging device, as illustrated, as well as a slingshot or other suitable propelling device.

In a first preferred variant, the foam projectile, for use with such as a toy disc discharging gun or rifle, is formed of a soft deflectable material, in a substantially disc or coin shape, and such that it includes first 14 and second 16 circular shaped and spaced apart faces separated by an annular edge surface 18. The foam construction of the disc 10 is such that it provides for safe discharge and operation of the disc 10 elements, such as by children.

One or more lighting elements are supported within the foam projectile body and such that an illuminating light associated with each element is evident from a surface of the body. In the preferred embodiment, the lighting elements are provided as LED bulbs, these having the capability of absorbing the forces attendant with being fired from a discharging device and without breakage.

Figure 2:
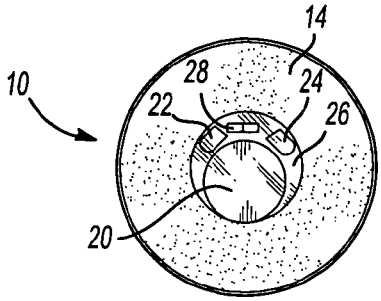
FIG. 2 is plan view of the foam disc projectile illustrated in FIG. 1 and exhibiting the LED elements in a central embedded location upon a face of the disc projectile.

A suitable battery, such as of the watch variety and exhibiting light weight and portability, is embedded within the foam projectile body 10 as shown at 20 and provides power to LED elements 22 and 24 illustrated in FIG. 2. Although not shown, it is understood that suitable thin gauge electrical wire, conductive foil or the like can be provided between the battery 20 and the individual lighting elements 22 and 24 and in order to electrically communicate the same.

The battery 20 is illustrated as being located in a central enclosed portion of the foam body 12, and such that the LED elements are also visible from selected face 14. It is also envisioned that the arrangement of the individual LED elements is such that their illuminating light can be evidenced from both the first 14 and second 16 faces, this such as occurring by embedding the battery and LED elements within the central enclosed portion and in the form of a transparent element 26 centrally located within the disc body 10 and as is clearly referenced in FIGS. 1 and 2.

A switch 28 is located upon the body 10, such as is illustrated in an exteriorly accessible fashion and in order to selectively provide battery power to the individual LED bulbs 22 and 24. As shown, the switch 28 may be mounted to a surface location of the central transparent portion 26 and in order to provide ease of access. Although not shown, it is understood that the switch could be reconfigured as a push button arrangement which facilitates on/off connection between the battery 20 and LED bulbs 22 and 24.

Figure 3:
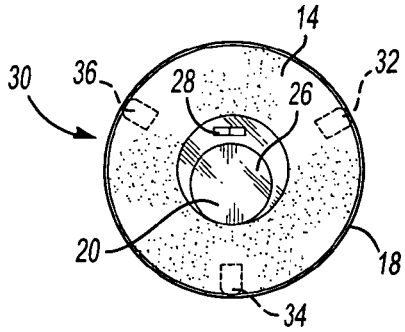
FIG. 3 is a plan view of an alternately configured foam disc projectile and in which a plurality of LED elements are arranged about an annular edge periphery of the disc element.

Referring further to FIG. 3, an alternate arrangement is shown at 30 of a foam shaped disc body. Of relevant note, the body 30 differs from that shown at 10 in FIGS. 1 and 2 in that a plurality of LED bulbs 32, 34 and 36 are arranged at specified and visible surface locations about the annular peripheral edge surface 18 of the body. It is also understood that the LED bulbs can illuminate in one or more of any range of colors.

Figure 4:
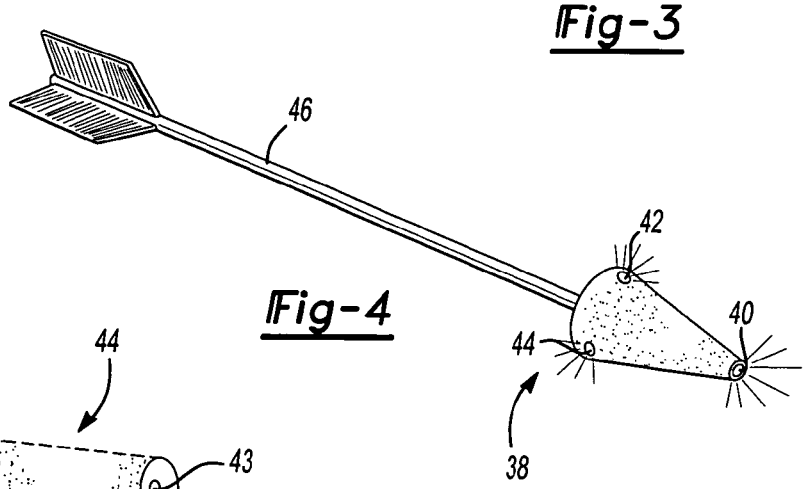
FIG. 4 is a perspective view of a conical shaped foam projectile according to a second preferred variant of the present invention and which is mounted to an arrow shaft.

Referring to FIG. 4, a further variant of a foam projectile device is illustrated at 38 and is provided in a generally conical shape. The projectile device 38 includes a first LED bulb 40 located in a substantially pointed nose end of the conical foam shape, as well as additional LED bulbs 42, 44, et seq., located about a base periphery. An associated battery (not shown) is further capable of being supported upon an attaching end of an arrow shaft 46 and the assembly is capable of being fired by a bow (not shown).

Figure 4A:
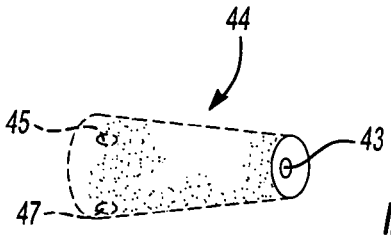
FIG. 4A is a perspective view of a modified cylindrical shaped projectile and which also illustrates LED elements embedded within the foam projectile.

Referring to FIG. 4A, a modified cylindrical shaped projectile is illustrated at 41. It is also contemplated that the cylindrical projectile can adopt a modified conical shape, such as is illustrated, or a straight cylindrical shape within the scope of the invention. It is also envisioned that the LED elements, such as are illustrated in phantom at 43, 45 and 47, may be completely embedded within the foam projectile body and which can still provide the necessary degree of luminescence while increasing the safety factor of the projectile fired.

Figure 5:
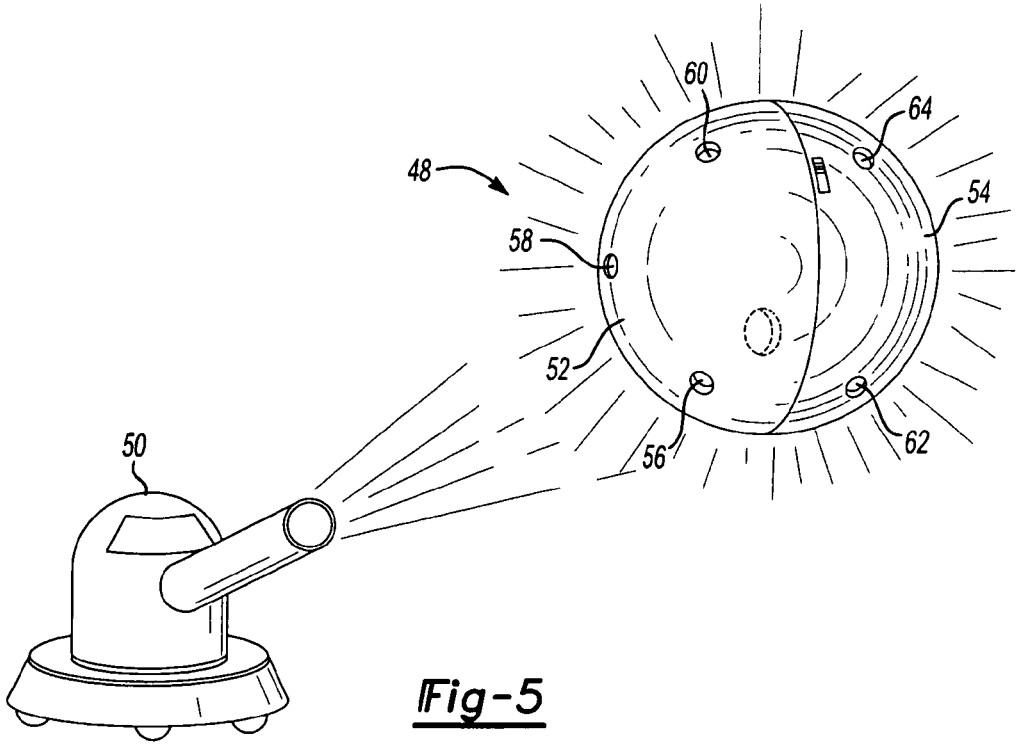
FIG. 5 is an environmental perspective of a foam ball projectile exhibiting a plurality of surface evident LED elements according to a further preferred variant of the present invention.
Figure 6:
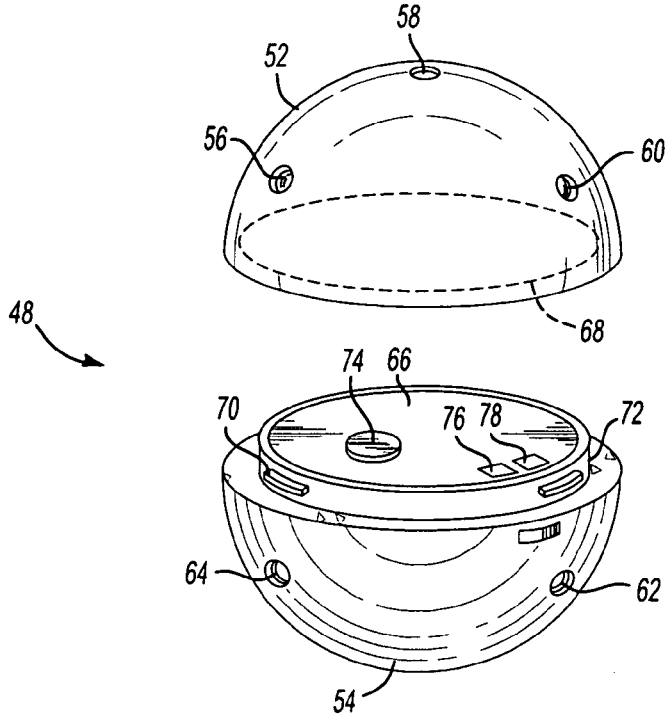
FIG. 6 is an exploded view of the foam ball projectile according to the variant of FIG. 5 and illustrating the first and second semi-spherical engaging halves of the foam ball according to the present invention.

Referring finally to FIGS. 5 and 6, a further variant of the foam projectile device is provided at 48 in a substantially spherical shape and upon which are illustrated a plurality of individual LED bulbs. As is illustrated generally at 50, a suitable ball cannon or the like can be employed for discharging the foam projectile 48.

In the third variant, the foam projectile ball 48 is provided as a two-piece and assembleable item with first 52 and second 54 semi-spherical shaped halves. Each of the halves 52 and 54 includes a plurality of LED elements, see at 56, 58 and 60 for halve 52 and at 62 and 64 for halve 54, in total arranged at locations about a spherical surface periphery.

To assist in assembly, interengaging elements 66 and 68 are provided between exposed inner surfaces associated with the assembleable halves of the foam shaped ball. The elements exhibiting such as a twist and lock engagement, as evident from laterally extending and circumferentially spaced tabs 70 and 72 exhibited upon element 66 and in order to maintain the structural integrity of the ball in use. Although not clearly shown, it is understood that suitable slotted portions may be formed in the element 68 illustrated in phantom and in order to accomplish the desired twist and lock engagement of the device.

In this variant, battery 74 is supported upon the rigid interior element 66, such as a selected one of the interengaging elements. As is also shown in the exploded view of FIG. 6, contact elements 76 and 78 are provided upon an exposed surface of the rigid interengaging element 66 and in order to electrically communicate with additional contact points (not shown) associated with the rigid element 68 in order to provide for communication of the battery 74 with the bulb elements 56, 58 and 60 in the matingly engaging half 52 and in addition to those located at 62 and 64 in the battery supported halve 54.

The three-dimensional foam projectile articles disclosed herein are without limitation and are intended only to illustrate some potential configurations within the scope of the invention. It is also envisioned that other shapes, such as including football, golf ball, Frisbee, dart and the like can be assembled from the foam material and without departing from the scope of the present invention.

Having described my invention, other and additional preferred embodiments will become apparent to those skilled in the art to which it pertains and without deviating from the scope of the appended claims:

I claim:

1. A disc shaped projectile adapted to being discharged from a suitable device in a combined linear traveling and rotating fashion, said projectile comprising:

a three-dimensional shaped body constructed of a foam material exhibiting a disc shape with first and second circular faces separated by an annular outer edge;

at least one LED lighting element supported within said body and visible from said annular outer edge;

a battery supported within said body and electrically communicating said LED lighting elements; and a switch accessibly located upon said body and for selectively engaging or disengaging said battery with said LED lighting element;

said lighting element providing an illuminating effect to said projectile as it is discharged from the device.

2. The projectile as described in claim 1, said LED bulb being evident from at least one of said circular faces.

3. The projectile as described in claim 1, said LED bulb being evident from an annular inner edge location defined between said first and second circular faces.

4. The projectile as described in claim 1, said three-dimensional shaped body exhibiting a specified shape and size, said battery further comprising a disc shaped watch battery.

5. The projectile as described in claim 1, further comprising said plurality of LED elements arranged proximate to surface locations associated with said three-dimensional shaped body, each of said LED elements exhibiting a specified color.

6. A projectile adapted for being discharged from a suitable device, comprising:

a three-dimensional shaped body comprising at least one of a substantially conical or modified conical shape and constructed of a foam material;

a plurality of LED lighting elements supported within said body and visible from selected surface locations of said body, a first LED bulb being located at a forward terminating location of said conical shaped body, at least one second LED bulb being situated at a further conical extending location;

a portable battery supported within said body and electrically communicating said lighting elements; and a switch accessibly located upon said body and for selectively engaging or disengaging said battery with said lighting element;

said lighting element providing an illuminating effect to said projectile as it is discharged from the device.

7. The projectile as described in claim 6, said conical shaped body exhibiting a specified shape and size and further comprising an arrow shaft secured to a base surface thereof.

8. A projectile adapted for being discharged from a suitable device, comprising:

a three-dimensional and substantially spherical shaped body constructed of a foam material and including first and second assembleable halves;

a plurality of LED lighting elements supported within said foam material body and visible from surface locations of said body;

a battery supported within said body and electrically communicating said LED lighting elements; and a switch accessibly located upon said body and for selectively engaging or disengaging said battery with said lighting element;

said lighting element providing an illuminating effect to said projectile as it is discharged from the device.

9. The projectile as described in claim 8, further comprising interengaging portions associated with exposed inner faces of said assembleable halves.

10. The projectile as described in claim 9, further comprising said battery secured upon a selected one of said interengaging portions.

11. A projectile, comprising:

a three-dimensional shaped body constructed of a foam material;

a plurality of LED elements mounted in said body in proximately located and visible fashion from various surface locations thereof;

a lightweight battery being supported within said body and electrically communicating with each of said LED elements; and a switch accessible from an exterior location of said body and for selectively activating and deactivating said battery;

said LED lighting elements providing an illuminating effect to said projectile as it is discharged for airborne travel.

* * * * *